US005811675A

United States Patent [19]

Hamer

[11] Patent Number: 5,811,675

[45] Date of Patent: Sep. 22, 1998

[54] MODULAR GAS UNITS

[75] Inventor: Mark Joseph Hamer, Rochdale, England

[73] Assignee: Siemens Measurements Limited, Oldham, England

[21] Appl. No.: 755,141

[22] Filed: Nov. 22, 1996

[30] Foreign Application Priority Data

Dec. 2, 1995 [GB] United Kingdom ..... 9524684

[51] Int. Cl.[6] ..... B67B 7/00

[52] U.S. Cl. ..... 73/198; 722/14

[58] Field of Search ..... 73/198; 222/3, 222/14, 71, 153.01

[56] References Cited

U.S. PATENT DOCUMENTS

| | | | |
|---|---|---|---|
| Re. 29,495 | 12/1977 | Georgi | 222/14 |
| 1,377,635 | 5/1921 | Smith | 222/3 |
| 3,586,050 | 6/1971 | Totten . | |
| 4,550,859 | 11/1985 | Dow, Jr. et al. | 222/14 |
| 5,124,934 | 6/1992 | Kawamoto et al. | 222/14 |
| 5,133,480 | 7/1992 | Matsumoto et al. | 222/14 |
| 5,257,538 | 11/1993 | Spendell . | |
| 5,433,342 | 7/1995 | Luro | 222/14 |

FOREIGN PATENT DOCUMENTS 0 616 201 9/1994 European Pat. Off. .

*Primary Examiner*—Robert Raevis

*Attorney, Agent, or Firm*—Evenson, McKeown, Edwards & Lenahan, PLLC

[57] ABSTRACT

A modular gas meter comprising a basic meter module, including a solenoid operated gas valve, a gas flow measurement arrangement and a gas valve control system, including a first optical interface which facilitates the transmission of control data to or from the control system, which basic module is adapted to be operatively combined with an add-on module so as to extend meter functionality, which add-on module comprises a module control system, which operates to control functionality and which includes a second optical interface, arranged for communication with the first optical interface when the two modules are mutually operatively combined, so that when functionality demands, an appropriate request signal is transmitted via the optical interfaces to request opening of the gas valve, and a manually operated switch to which the module control system is responsive for sending an enable signal via the interfaces to the valve control system, whereby operation of the gas valve to effect gas supply via the meter in response to a request signal is effected only if the switch is contemporaneously operated to provide the enable signal.

4 Claims, 1 Drawing Sheet

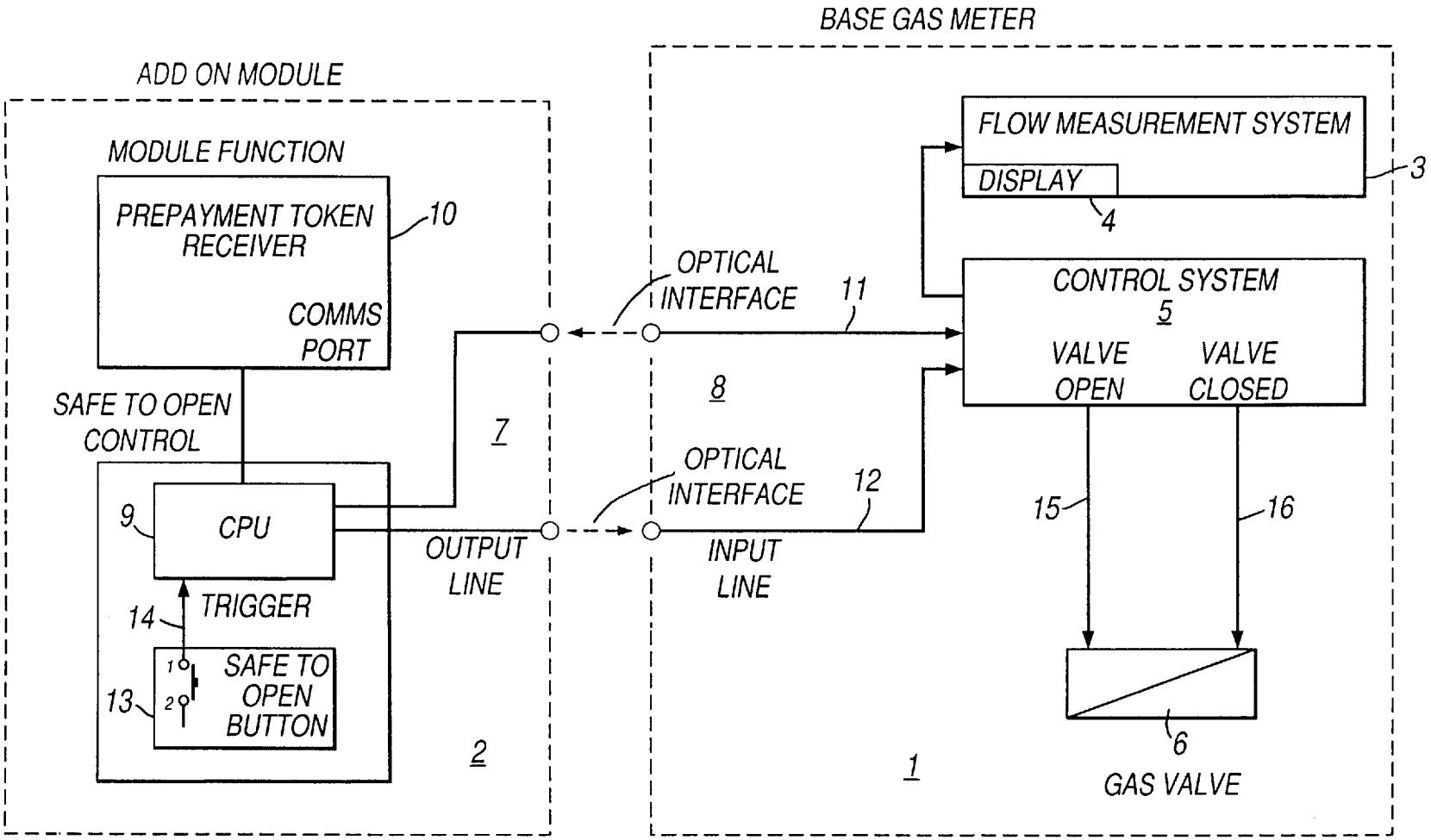
BASE GAS METER
FLOW MEASUREMENT SYSTEM
DISPLAY
3
4
CONTROL SYSTEM
5
VALVE OPEN
VALVE CLOSED
16
15
6
GAS VALVE
1
11
12
OPTICAL INTERFACE
8
OPTICAL INTERFACE
INPUT LINE
7
OUTPUT LINE
2
ADD ON MODULE
MODULE FUNCTION
PREPAYMENT TOKEN RECEIVER
COMMS PORT
10
SAFE TO OPEN CONTROL
CPU
9
TRIGGER
14
SAFE TO OPEN BUTTON
13

MODULAR GAS UNITS

This invention relates to gas meters and more especially it relates to modular gas meters.

Modular gas meters comprise a basic meter module to which add-on modules may be selectively fitted to extend or modify functionality. Thus, a basic meter module is provided which may be contiguously combined with various alternative add-on modules, so as to provide for various different functions such as pre-payment facilities, remote meter reading, or credit meter facilities, for example. Modular meters are described in our co-pending GB patent application No. 9518610.2, to which attention is hereby directed.

In a modular meter, a gas valve is normally provided in the basic meter module, which is controlled in accordance with signals generated in an add-on module combined therewith. Thus, in a pre-payment meter, for example, the gas valve in the basic meter module is opened or closed in accordance with the provision of pre-payment tokens, or the like, which can be fed into the add-on module.

It will be apparent that when credit becomes exhausted, gas will be turned off, to be turned on again only after provision of appropriate credit tokens. Thus, when a gas supply is resumed after a period of disconnection, gas burners or other appliances may inadvertently be left on, which represents a possible safety hazard.

It is an object of the present invention to provide a modular gas meter, wherein the aforesaid hazard is obviated, at least in part.

According to the present invention, a modular gas meter comprises a basic meter module, including an electrically operated gas valve, a gas flow measurement arrangement and a gas valve control system, including a first optical interface which facilitates the transmission of control data to or from the control system, which basic module is adapted to be operatively combined with an add-on module so as to extend meter functionality, which add-on module comprises a module control system, which operates to control functionality and which includes a second optical interface, arranged for communication with the first optical interface when the two modules are mutually operatively combined, so that when functionality demands, an appropriate request signal is transmitted via the optical interfaces to request opening of the gas valve, and a manually operated switch to which the module control system is responsive for sending an enable signal via the interfaces to the valve control system, whereby operation of the gas valve to effect gas supply via the meter in response to a request signal is effected only if the switch is contemporaneously operated to provide the enable signal.

The electrically operated valve may be a solenoid operated valve.

The two modules may be contiguously combined or alternatively they may be remote from each other and coupled via an optical link which couples the optical interfaces. The word 'optical' when used herein, is used in a general sense and applies to devices/apparatus which utilise light in the non-visible spectrum, i.e. infra-red or alternatively light in the visible spectrum.

Thus, in the case of a pre-payment meter, for example, insertion of a credit card or token, which initiates generation of a gas request signal, will be responded to only if the switch is also operated so as to provide the enable signal via the optical interfaces. Thus, it is apparent that the gas valve cannot be opened solely by the insertion of a token, a credit card or the like, whereby inadvertent gas valve operation, which could be safety hazard, is obviated.

It will be appreciated that although the invention is eminently applicable to pre-payment meters, it is equally applicable to meters which are remotely operated, or to meters which include seismic or temperature sensing devices effective to shut off the gas supply by closing the gas valve. In these cases, request signals to open the valve so as to re-commence supply will be responded to only if the switch is contemporaneously operated to provide the enable signal. The gas valve control system may effectively include two serially connected switches, responsive respectively to the request signal and the enable signal.

One embodiment of the invention will now be described by way of example only with reference to the accompanying drawing, which is a somewhat schematic block/circuit diagram of a gas meter comprising an add-on module operatively associated with a basic meter module.

Referring now to the drawing, a gas meter comprises a basic meter module 1, which is operatively associated with and contiguously combined with an add-on module 2. The add-on module 2 provides additional functionality and in this case affords a pre-payment facility. The basic meter module comprises a flow measurement system 3, in dependence upon which a display 4 is operated which provides an indication of the volume of gas consumed. The measurement system 3 operates under control of a basic meter module control system 5, which serves also to control operation of a solenoid operated gas valve 6. In order to provide for communication between the basic meter module 1 and the add-on module 2, a pair of optical interfaces 7 and 8 are provided, which facilitate communication between the basic meter module control system 5 in the basic meter module 1 and an add-on module control system 9 in the add-on module 2. Although in this embodiment, two optical interfaces are provided, in an alternative embodiment it is contemplated that a single optical interface may be used serve the same purpose. As hereinbefore explained, the add-on module 2 in this example, provides a pre-payment facility and for this purpose includes a pre-payment token receiver 10, which is adapted to receive pre-payment tokens. When a consumer's credit for the supply of gas has expired, the basic meter module control system 5 operates to switch off the gas valve 6. In order to open the gas valve 6 again, it is necessary to prime the pre-payment token receiver 10 of the add-on module 2 with an appropriate token. In response to insertion of a token, signals are transmitted from the token receiver 10 to the add-on module control system 9 which then generates data 'flag' signals (which 'flag' signals may be as specified by International Electrotechnology Commission [IEC] standards regulation 1107) which are transmitted across the optical interface 7 to the basic meter module control system 5. These signals on a line 11, which amount to gas request signals, are ignored unless an enable signal is also provided on a line 12 via the optical interface 8 from the add-on module control system 9. This enable signal is generated responsively to operation of a switch 13. Consequent upon manual operation of the switch 13, trigger signals are fed via a line 14 to the add-on module control system 9 and appropriate signals are then fed via the optical interface 8 and the line 12 to the basic meter module control system 5. If contemporaneous signals are provided on the lines 11 and 12, a signal is provided on line 15 to open the gas valve 6. A further line 16 is provided which couples the gas valve to the control system and which is used to carry signals for closing the valve.

It will be appreciated that with an arrangement as just before described, operation of the gas valve 6 to open it after a period of shut down can be effected only by arranging that signals are contemporaneously present on the lines 11 and 12.

Although in the present example, a pre-payment token receiver 10 is provided to facilitate the provision of pre-payment facilities, alternative functions may be provided by other alternative add-on modules, which may, for example, provide for remote meter operation, or seismic sensing, so that shut down can be effected in the event of an earthquake, and in these cases, restarting of the gas supply can be effected only by the provision of appropriate signals on the lines 11 and 12, or on lines corresponding thereto, which may in some circumstances require action by a representative of the utility responsible for gas supply.

Although not shown in the drawing, a battery compartment is provided in the basic meter module, which houses a battery used to provide electrical power as required for the various parts of the basic module, including the solenoid operated valve. This battery, which has an extended life of ten years, is not used in this embodiment to provide power for the add-on module in which an additional battery is provided. However, in an alternative embodiment a single battery may be used which is housed in the basic meter module, power being transmitted to the add-on module via the two halves of an electrical connector (not shown), which are provided in the basic module and the add-on module respectively, and which are mutually engaged when the modules are contiguously combined.

I claim:

1. A modular gas meter comprising a basic meter module, including a solenoid operated gas valve, a gas flow measurement arrangement and a gas valve control system, including a first optical interface which facilitates the transmission of control data to or from the control system, which basic module is adapted to be operatively combined with an add-on module so as to extend meter functionality, which add-on module comprises a module control system, which operates to control functionality and which includes a second optical interface, arranged for communication with the first optical interface when the two modules are mutually operatively combined, so that when functionality demands, an appropriate request signal is transmitted via the optical interfaces to request opening of the gas valve, and a manually operated switch to which the module control system is responsive for sending an enable signal via the interfaces to the valve control system, whereby operation of the gas valve to effect gas supply via the meter in response to a request signal is effected only if the switch is contemporaneously operated to provide the enable signal.

2. A modular gas meter as claimed in claim 1, wherein the add-on module is a pre-payment module adapted to receive credit cards or tokens in response to the provision of which the request signal is generated.

3. A modular gas meter as claimed in claim 1, wherein the gas valve control system is arranged effectively to include two serially connected switches, responsive respectively to the request signal and the enable signal.

4. A modular gas meter as claimed in claim 1, wherein the solenoid operated valve is arranged to be opened or closed in dependence upon the sense or polarity of operating pulses applied thereto.

* * * * *